US009010247B2

(12) United States Patent
Caballer Barat

(10) Patent No.: US 9,010,247 B2
(45) Date of Patent: Apr. 21, 2015

(54) PYROTECHNICS LAUNCHING DEVICE

(75) Inventor: Vicente Caballer Barat, Liria (ES)

(73) Assignee: Pirotecnia Caballer, S.A., Liria (Valencia) (ES)

( * ) Notice: Subject to any disclaimer, the term of this patent is extended or adjusted under 35 U.S.C. 154(b) by 0 days.

(21) Appl. No.: 13/991,307

(22) PCT Filed: Dec. 1, 2010

(86) PCT No.: PCT/ES2010/070792
§ 371 (c)(1),
(2), (4) Date: Aug. 13, 2013

(87) PCT Pub. No.: WO2012/072832
PCT Pub. Date: Jun. 7, 2012

(65) Prior Publication Data
US 2014/0007787 A1 Jan. 9, 2014

(51) Int. Cl.
*F42B 4/24* (2006.01)
*F42B 4/02* (2006.01)
*F42B 4/20* (2006.01)

(52) U.S. Cl.
CPC ... *F42B 4/02* (2013.01); *F42B 4/20* (2013.01); *F42B 4/24* (2013.01)

(58) Field of Classification Search
CPC ..... F42B 4/24
USPC ..... 102/357, 358, 361, 343, 360; 89/1.816
See application file for complete search history.

(56) References Cited

U.S. PATENT DOCUMENTS 5,979,329 A 11/1999 Collar
7,410,135 B1 8/2008 Dibble et al.

FOREIGN PATENT DOCUMENTS

EP 2 669 618 4/2013
ES 2 268 940 A1 3/2007
ES 2 287 458 12/2007
JP 3114578 U 10/2005

OTHER PUBLICATIONS

PCT International Search Report issued Aug. 3, 2011 in connection with PCT International Application No. PCT/ES2010/070792, filed Dec. 1, 2010.
Written Opinion of the International Searching Authority issued Aug. 3, 2011 in connection with PCT International Application No. PCT/ES2010/070792.

*Primary Examiner* — Reginald Tillman, Jr.
(74) *Attorney, Agent, or Firm* — Gary J. Gershik; Cooper & Dunham LLP

(57) ABSTRACT

A pyrotechnic launcher that comprises at least one pyrotechnic launching tube (1), at least one frame which comprises cover (2), and in which said pyrotechnic launching tube (1) is prepared for housing inside it at least one pyrotechnic device (8); in which said pyrotechnic launching tube (1) comprises at least two openings located at its top and bottom ends that enable the introduction and deployment of the pyrotechnic device (8), both through its top opening and its bottom opening, in which at least one locking element (3) holds said pyrotechnic device (8); and in which the internal face of said pyrotechnic launching tube (1) comprises some interlocking means (17*a*) which enable locking said pyrotechnic device (8) in a direct manner or by means of an intermediate element, through some locking means (17*b*, 17*b*') pertaining to said pyrotechnic device (8).

19 Claims, 5 Drawing Sheets

PYROTECHNICS LAUNCHING DEVICE

RELATED APPLICATIONS

This application is a §371 national stage of PCT International Application No. PCT/ES2010/070792, filed Dec. 1, 2010, the contents of each of which are hereby incorporated by reference into this application.

TECHNICAL FIELD OF THE INVENTION

The present invention refers to a series of improvements introduced in the firing systems of pyrotechnics and fireworks that affect different parts thereof, such as the geometry of the launch tubes, the arrangement of the fireworks housed inside the launching tube, as well as retaining means that affect both parts for enabling coupling inside it, and a new fixing system for a plurality of pyrotechnic launching tubes to the corresponding frame.

BACKGROUND OF THE INVENTION

When firing fireworks the pyrotechnic launcher tubes, also called mortars, are known and consist in a cylindrical body closed on the bottom, which houses inside both the objects or pyrotechnic materials, such as the shell or fountains, and the projection load, also called lifting propellant. Any pyrotechnic component housed inside the mortar is projected outwards to produce a visual and/or audible effect by means of the gases generated by the combustion of the projection load. The projection of one or another type of pyrotechnic material is produced in different ways, causing a different effect.

For the purpose of aiding the understanding of the present document and given the particular terminology used in some of the different prior art that will be cited below, it is considered particularly important to clarify the following concepts:

Conventionally and in general terms, a shell is a pyrotechnic device that is structured with a plastic or cardboard casing, having a geometric cylindrical or spherical shape, that contains a projection load which is ignited through an ignition conduit by means of a squib or fuse, generating gases whose thrust, channeled though a pyrotechnic launch tube, projects the shell upwards, emerging to the exterior of the pyrotechnic launching tube. The delay in the transmission of lighting of the shell is produced by the operation of a delayed fuse that is ignited by the projection load; this burns during the launch of the shell and ignites the explosive load located inside the casing when the shell reaches its zenith, provoking the brusque and instantaneous opening of the box, propelling and lighting the pyrotechnic materials that will create the desired effect at a great height.

Conventionally a fountain is a device having a operating principle that is similar to that described for the shells, with the exception that this does not have a delay fuse and is designed so that the casing holding the pyrotechnic components remains inside the mortar in the moment it is fired, opening the top portion of said casing enabling the components to produce their visual and audible effect, by means of the emission of flashes of light that emerge from the mouth of the mortar at a reduced height.

Customarily, both the shells and the fountains are devices designed to be fired from inside an appropriate mortar for their calibre.

The assembly resulting from the manufacturing process having one or several of these devices inside a single cylindrical mortar, fixing its load to the internal mortar wall by means of internal retention elements such as sealing washers or similar, is called a Roman candle. Therefore, a Roman candle is understood to be the device shaped by a cylindrical tube, generally cardboard or plastic, that fires one or several objects or pyrotechnic materials housed inside it, these being any type, such as a fountain type, shell (or mini-shell) and kite, which, with the possibility of the cooperation of an intermediate screen, are separated from the projection load, said tube being closed at its top end by means of a top cover, the cylindrical tube having the ability to be fixed, for example, to a frame or including a flange that enables its support, in which the Roman candle tube forms part of the device itself.

Said Roman candles have a mortar in their structural assembly, inside of which the pyrotechnic components are housed. These remain immobilized inside the cylindrical tube, fixed by retaining gaskets or any other element that can carry out this mission. This type of retaining system, which is always located on top of the pyrotechnic components, is the conventional and common system employed for manufacturing the Roman candles.

The use of the cited devices, namely, shells, fountains and Roman candles, has several drawbacks.

- It entails a technical disadvantage because those firings in which the mortar must have some inclination, a shifting occurs of the pyrotechnic load inside it when being put in place. To avoid these movements, retaining elements are usually used on top of the load, such as locking discs, which actuate by putting pressure on the inside wall of the mortar, avoiding movement of the load and cooperating to exercise sufficient compression so that the pyrotechnic materials are lifted up the necessary height. These elements are unavoidably ejected outside, pushed by the device itself, creating an inconvenient increase of residues and hazards if the devices are close to the public. There are retaining elements that burn before being ejected from the mortar, but these are very expensive and not common in conventional use.
- Furthermore, all of the pyrotechnic components have to be deployed inside a cylindrical mortar, permanently closed on the bottom face by glue, staples, screws or threads with respect of a bottom base, for which the loading operation always needs to be carried out through the top portion of the mortar. This entails the need to lengthen the ignition means, either a fuse or an electric igniter, extracting it from the top portion of the mortar itself, or through an orifice made in the side of the mortar.

In the case of Roman candles, we are faced with additional drawbacks.

- In these types of devices the projection load is conventionally deployed inside the mortar, without using any type of container. The pyrotechnic components are deployed on top of it. In this way, the mortar itself, which forms part of the structural assembly of the devices, is what actuates as a type of recipient for housing the lifting or projection load. This leads to the consequence that the combustion of the mortar deteriorates it, complicating its subsequent reuse.

The invention at hand tries to resolve the aforesaid drawbacks so that:

- The pyrotechnic load is isolated inside the mortar in a safe and sealed manner.
- Subsequent use of the mortar is made possible for new firings, as it does not become deteriorated.
- The separation of unnecessary structural elements is avoided, obtaining greater safety during the fireworks show, because it does not require any additional locking element, thus avoiding it being propelled outside and eliminating the danger of it falling among the public and subsequent clean up tasks.

It assures the pyrotechnic materials are fixed inside the pyrotechnic tube and guarantees a better contact of an electric igniter located inside the device and a locking element.

The fact that the pyrotechnic load may be introduced from either the bottom or the top portion of the mortar, makes it possible to include in the design of the device non-detachable locking means that cooperate with the internal face of the mortar, avoid shifting during assembly, improve the safety system and make its installation easier.

It improves the compression of the gases during combustion without the need of using detachable locking elements on top of the pyrotechnic materials.

Conventionally, mortar is understood to mean a tube that is used to project pyrotechnic components, and so it constitutes a separate piece from the device.

The applicant hereof holds Spanish Patent ES 2287458, consisting in a locking system for non-reusable pyrotechnic launch tubes, specifically for those that consist in the pyrotechnic launch tubes themselves, equipped with a cylindrical body housing inside it both the objects or pyrotechnic materials and the lifting propellent, which is characterized in that said tube is equipped on its bottom end with a plurality of tabs which, as a set, configure a cylindrical, radial and elastically deformable neck, in which said tabs terminate on respective locking barbs on top of a locking piece, fixable to the frame of the tubes or integrated onto this frame to form a single piece. Furthermore, the pyrotechnic launch tube is adapted for housing an igniter inside it with its corresponding feeder cable; however, this launch tube has a small opening on its bottom portion which is not equipped for introducing a pyrotechnic device through it; rather it is only for housing said igniter. This makes it necessary to perforate the base of the launch tube by making an orifice for said housing, which may complicate maintaining its airtightness, resulting in the entry or filtration of gases during ignition and even the need of placing the igniter before the lifting propellent so as to keep the propellent from falling out of said orifice.

The intervention at hand further tries to improve different features of the frame itself, such as the locking system between it and the pyrotechnic launch tubes, being now reusable and exchangeable, with anchoring devices that provide greater safety to the assembly and a considerable increase in reliability, as well as the introduction and installation of a pyrotechnic device both through the bottom portion and the top portion of the pyrotechnic launch tubes, unlike the state of the art.

DESCRIPTION OF THE INVENTION

The present invention refers to a pyrotechnic launch devices that comprises at least one pyrotechnic launching tube, at least one frame, which comprises a cover, in which at least one said pyrotechnic launching tube may be coupled and decoupled, in which at least one said pyrotechnic launching tube is prepared for housing inside it at least one pyrotechnic device;

in which, furthermore, at least one said pyrotechnic launching tube comprises at least two openings located at its top and bottom ends that enable introducing and housing at least one said pyrotechnic device, both through its top opening and through its bottom opening, in such a way that it serves as a guide, at least partially, for the trajectory of said pyrotechnic devices in the moment of their launch;

in which at least one independent element of said pyrotechnic launching tube and of the device itself, consists in a locking element, and is apt for being placed after the introduction and housing of the pyrotechnic device, holds at least one said pyrotechnic device and is located underneath the same.

and in which the inside face of at least one said pyrotechnic launching tube comprises the interlocking means that enable blocking at least one said pyrotechnic device, in a direct manner or with an intermediate element, through one of the blocking means pertaining to at least one said pyrotechnic device.

Just as they are described, said interlocking means may engage directly without additional elements; that is, between the pyrotechnic launching tube and the blocking means of the pyrotechnic device; or by the interposing of an independent element between the pyrotechnic device and the pyrotechnic launching tube, said element being housed independently between both, as described further down.

The ability to introduce and arrange said pyrotechnic devices through both the bottom and top openings of said pyrotechnic launching tube is seen as an advantage and as an important difference with respect to the state of the art, by facilitating the installation operation and providing greater safety for handling and executing said pyrotechnic devices, and also, because of the aforesaid interlocking means between the inside face of at least one said pyrotechnic launcher, which enables locking at least one said pyrotechnic launcher together with its respective locking means, which are described below in greater detail.

The possibility is considered in which at least one said pyrotechnic device comprises an igniter, which could be an electric type, apt for providing the ignition of the projection load, housed between at least one said pyrotechnic device and said locking element.

Additionally, the possibility is considered of that at least one said locking element comprises a geometric plate and comprises at least a substantially cylindrical support. The support could be perimeterally reinforced with nerves, and, just as stated previously, hold at least one said pyrotechnic device to keep it from shifting towards the interior of the base, besides being able to buffer the impact of its explosion.

In a preferred embodiment, the possibility is considered in which at least one said pyrotechnic device comprises a preferably cylindrical body configuration, apt for being loaded from both the top portion and the bottom portion of at least one said pyrotechnic launching tube and housed in its hollow space, which comprises the two openings located on its top and bottom ends.

Additionally the possibility is considered in which at least one said pyrotechnic devices comprises a geometry in such a way that:

a bottom portion called a shot bowl, which comprises at least one housing that enables inserting inside it a projection load and and a top portion called sheath that comprises at least one housing that enables inserting inside it a plurality of pyrotechnic components The described pyrotechnic device comprises blocking means apt for engaging with the interlocking means present on the internal face of at least one pyrotechnic launching tube, capable of locking at least one of the cited parts of the pyrotechnic device to at least one said pyrotechnic launching tube, selectively preventing that at least one of said parts of the pyrotechnic device, that is, the bowl or the sheath or even the body of the device formed by both parts, become detached and exit from the inside of the pyrotechnic launching tube to the outside.

Depending on the desired effect, as well as the height at which we want this to occur, said innovating solution of selective interlocking enables several system functions:

That the shot bowl remains fixed inside the pyrotechnic launching tube by the interlocking and locking means, and the sheath is detached/separated from the shot bowl, being ejected out of it. Preferably, this will be the case of the sheath corresponding to the shell model. (in which structure there is a housing for the explosive charge and another for disposing of a delay fuse).

That the body remains completely clamped inside of the pyrotechnic launching tube. That is, both the sheath and the shot bowl remain inside of said pyrotechnic launching tube after carrying out the firing, with only the pyrotechnic components being ejected to the outside. Preferably this would the case of the sheath corresponding to the fountain type, designed to produce effects without pyrotechnic delay, (with which it is unnecessary for any housing of the explosive load or for a delay fuse, just as occurs with the sheath corresponding to the shell). In this case the locking means can be deployed only in the shot bowl, only in the sheath, or even in both the shot bowl and the sheath.

In a preferred embodiment, for the case in which the device is loaded from the bottom portion of at least one said pyrotechnic launching tube and housed in said bottom portion:

the locking means comprise a peripheral flange, or a succession of several projections, for the case of a non-circular flange that externally surrounds at least one said pyrotechnic device, and the interlocking means comprise a peripheral staggering or sequence of multiple grooves on the inside face of at least one said pyrotechnic launcher tube which interlocks with said peripheral flange, or sequence of ridges, in a male-female manner.

In another preferred embodiment, not represented in the figures, for the case in which the device is loaded from the top portion of at least one said pyrotechnic launching tube and housed in said bottom portion:

the locking means provide at least one projection deployed on the outside of at least one said pyrotechnic device, and the interlocking means comprise at least one anchoring or groove (not shown) made vertically and deployed on the inside face of the body of at least one said pyrotechnic launching tube that enables shifting the device longitudinally along the internal face of the same, and finally its interlocking.

In a third preferred embodiment, not shown in the figures, the locking means deployed on the outside of at least one said pyrotechnic device; and the interlocking means deployed on the inside face of at least one said pyrotechnic launching tube, engage with a hoop or a ring independently installed between at least one said pyrotechnic launching tube, counting on its respective interlocking means that actuate with the aforesaid interlocking and locking means.

In reference to this third embodiment, there is the possibility in which, initially, the pyrotechnic launching tube comprises the interlocking means and they are coupled to said independent ring, in such a way that the locking means, belonging to the pyrotechnic device, do not come in contact with the independent ring and its respective interlocking means until after the ignition and lift off of said pyrotechnic device occurs; blocking in this way its ejection.

Additionally the possibility is considered in which the shot bowl is coupled to the sheath with respective coupling means in such a way that the parts that comprise each pyrotechnic device are coupled to them, likewise enabling the selective detachment of the sheath with respect of the shot bowl.

As an option, the possibility is considered in which at least one said pyrotechnic device comprises a cavity located inside the sheath of at least one said pyrotechnic device and in which at least one explosive load is housed.

As an option, at least one said pyrotechnic device comprises a cavity located inside the sheath of at least one said pyrotechnic device and in which at least one explosive load is housed. Said cavity could be located underneath with respect of the aforesaid cavity in which at least one explosive load is housed.

The possibility is considered in which the aforesaid features are apt for being applied to a plurality of pyrotechnic launching tubes coupleable to a frame, which enables, in a simple manner, the locking and unlocking action of each pyrotechnic launching tube is at the discretion of the user for choosing both the pyrotechnic device and the diameter of the launching tube.

Additionally, the possibility is considered in which the coupling of at least one of said pyrotechnic tube launchers over the cover is done with at least one orifice made on the cover, and in which said orifice has a geometrically circular base that comprises at least one semicircular peripheral notch and concentric to the circular geometry of said orifice; such that said pyrotechnic launching tube has on its bottom portion a cylindrical shape having a notably smaller dimension than the orifice and in which around the bottom contour there is at least one bevelled projection that engages with at lease one said notch in such a way that the projection is coupled to the notch and said pyrotechnic launching tube is rotated with respect of its revolving axis, remaining perfectly engaged in said orifice. Therefore, manual coupling is relatively easy, simply engaging at least one said projection in the respective notch and rotating said pyrotechnic launching tube on its rotating axis, ensuring the correct locking for the subsequent explosion of at least one said pyrotechnic device deployed inside the pyrotechnic tube launcher.

The possibility is considered in which the engagement means described between said launching tube and said orifice are made in an inverse manner, that is, switching the projections for the notches and the notches for the projections.

In a complementary manner, the possibility is considered in which at least one said pyrotechnic launching tube comprises a geometric base in common so as to enable the adaptation of at lease one said orifice independently of the calibre of said at least on pyrotechnic launching tube. Given that the geometry of the pyrotechnic launching tubes permits different diameters for housing different pyrotechnic device loads at the discretion of the operator in charge; they cam be exchangeable, reusable and easily replaced in the event they become deformed or break.

Optionally, when one of the orifices found on the cover of the pyrotechnic launching tube is not used because the show does not require it, at least one plug may be used which can cover said orifice, and this plug further comprises, on its bottom portion, a cylindrical shape having a notably smaller dimension than said orifice and on which around the bottom contour there is at least one projection bevelled that engages with at least one said notch in such a way that the projection couples with the notch and at least one said plug is rotated on its rotating axis, remaining perfectly engaged in said orifice. It is seen that the engagement is equivalent to that of said at least one pyrotechnic launching tube to the cover; in which at least one said plug enables blocking the entrance of possible pyrotechnic debris into the interior of the frame that could cause damage to, for example, the structure itself or the different elements that may be inside.

The possibility is considered in which the engagement means described between said cover and said orifice are made in an inverse manner, that is, switching the projections for the notches and the notches for the projections.

The possibility is considered of at least one locking element of flexible material being placed at the bottom portion of the cover in such a way that in comprises at least one locking element that is inserted inside a cavity bevelled in the midpoint of said engagement projection of at least one said pyrotechnic launching tube or of at least one said plug once it is engaged with the cover by means of a manual rotation. In this way, the assembly is provided with an increased level of safety, as well as making the actuation of at least one said blocking element more simple, easier and faster.

Additionally the possibility is considered in which at least one said blocking element comprises a joining element, such as a pin or screw type, between said blocking element and the cover, in such a way that the fixing of at least one said blocking element to the cover is ensured in a simple, safe and easy manner, avoiding possible uncoupling, especially during the moment of the explosion of at least one said pyrotechnic device.

Optionally, at least one flat gasket is positioned over the contour of said orifice and comprises a punch hole of the internal contour of said orifice, making said assembly airtight. At lease one said joint could be elastic or made of elastic material.

The possibility is considered of the frame being incorporated on base located underneath with respect of the cover, and having a peripheral gasket between both that creates the airtightness of the base with the cover, further guaranteeing that pyrotechnic debris or water or fluids do not enter into the interior of the frame, subject of the invention.

And so, in accordance with the invention disclosed, the frame proposed by the invention constitutes an advance in the pyrotechnic and firework firing systems in use up until now, and provides full, satisfactory solutions to the drawback explained above, while enabling reducing the time needed for its assembly and disassembly, which is done in a simple manner, with simple, robust and versatile manufactured elements, enabling the isolation of the pyrotechnic load inside the mortar in a safe and airtight manner, making possible subsequent use of the mortar for new firings given that it does not suffer deterioration; avoiding detachment of the pyrotechnic components, obtaining greater safety during the pyrotechnic show by dispensing with any additional locking elements such as discs or retaining covers or the like; furthermore, since these locking elements are not necessary, they are not ejected outwards, thus avoiding the danger they may cause by falling to the ground and during clean up work; and also, due to the fact that the pyrotechnic load is inserted through the bottom portion of the mortar, its shifting during assembly is avoided, the safety of the system is ensured, and its installation is easier.

DESCRIPTION OF THE DRAWINGS

To complement the description being provided and for the purpose of contributing to a better understanding of the features of the invention, in accordance with an example of a preferred embodiment of the same, as an integral part of said description a set of drawings is attached, having a non limiting illustrative character, and which depict the following.

PREFERRED EMBODIMENT OF THE INVENTION

Figure 1:
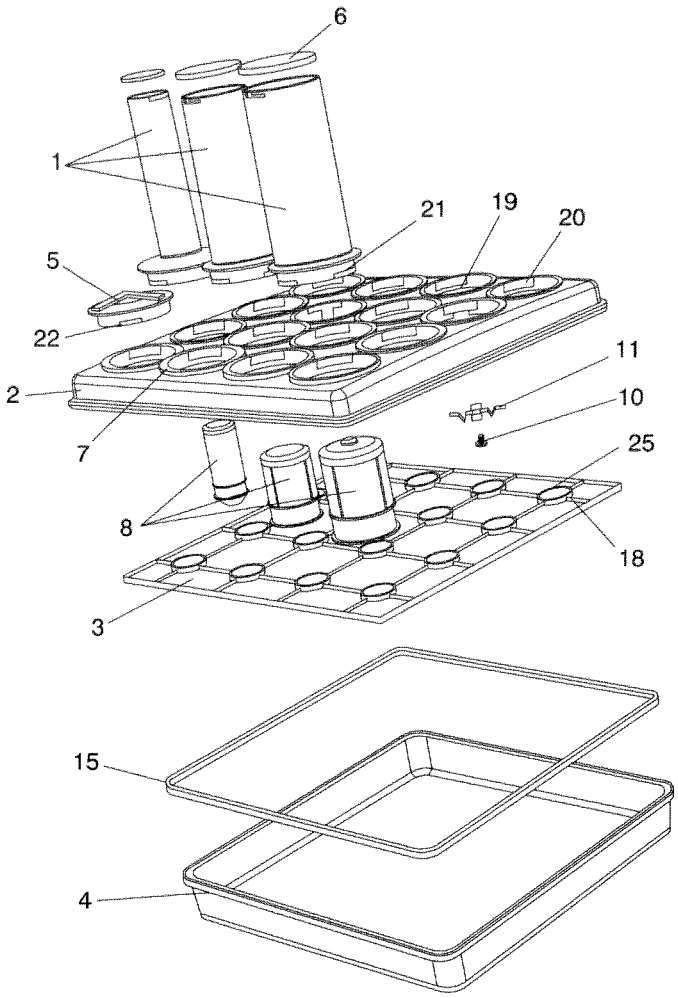
FIG. 1 shows a schematic exploded view of the elements of the pyrotechnic launching tube proposed by the invention.

Given that pyrotechnic launching tubes (1) are open at both the bottom and the top, it is possible to introduce and arrange pyrotechnic device (8) from either of the two pyrotechnic launching tube (1) openings, as locking element (3) is a locking plate used to hold pyrotechnic device (8), preventing it from exiting through the bottom, and exercising the necessary pressure and buffering the impact. Locking element (3) is apt for being inserted after inserting and housing pyrotechnic device (8), holding it and being deployed underneath with respect of the same.

Locking element (3) comprises a plate geometry which further comprises a plurality of notably cylindrical supports (25) peripherally reinforced by nerves (18)

Each pyrotechnic device (8) comprises a cylindrical geometry such that:

a bottom portion called a shot bowl (13) comprises a housing that enables inserting inside it a projection load (9), and a top portion called sheath (14) comprises a housing that enables inserting inside it a plurality of pyrotechnic components 16)

Figure 4:
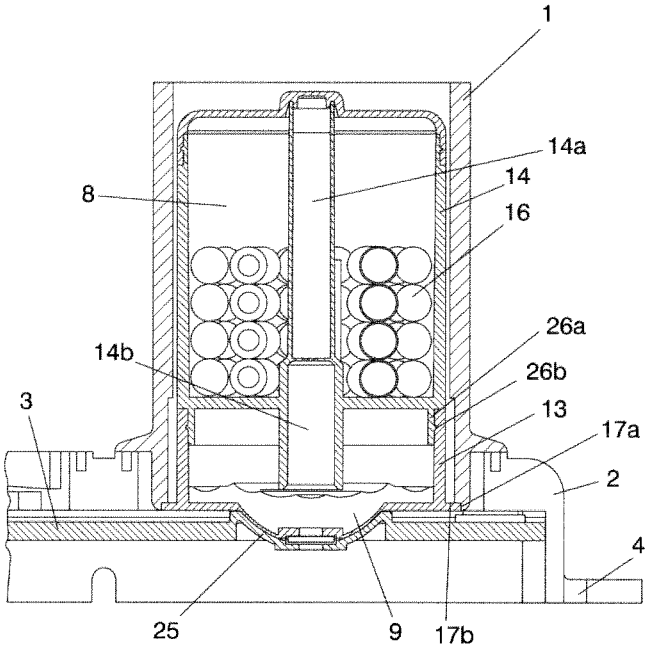
FIG. 4 shows a section view of a pyrotechnic device in relation to a shell, coupled at the bottom and interior portion of a pyrotechnic launching tube in accordance with an embodiment mode.

In light of FIG. 4, which makes reference to a shell type device, the interior face is seen of pyrotechnic launching tube (1) comprising some interlocking means (17*a*) that enable a partial locking of pyrotechnic device (8), in this case the locking of shot bowl (13), by means of some locking means (17*b*), in which:

locking means (17*b*) comprise a peripheral flange that externally encircles each pyrotechnic device (8), and interlocking means (17*a*) comprise a peripheral step located on the inside face of each pyrotechnic launching tube (1) that is interlocked with said peripheral flange in a male-female manner.

Likewise in light of FIG. 4, relative to the embodiment of the shell type device, it is seen how said shot bowl (13) is located coupled to its respective sheath (14) by means of coupling means (26), which comprises peripheral flange (26*a*) that externally encircles the cylindrical body of the sheath, in such a way that it makes it possible to couple it to peripheral groove (26*b*) that internally encircles the cylindrical body of the shot bowl, in such a way that both means effect a male-female interlock between each other, enabling sheath (14) to be detachable or separable from shot bowl (13) for its ejection towards the outside.

Figure 5:
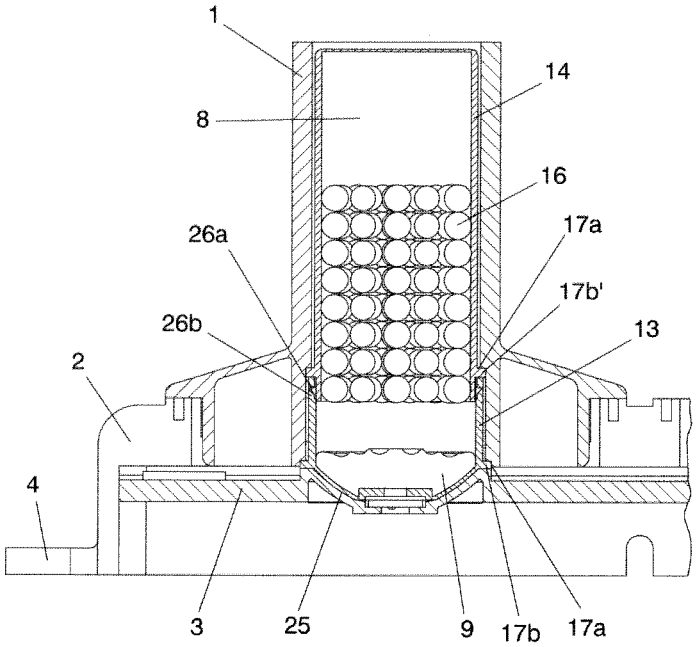
FIG. 5 Shows a view similar to the previous one, in this case in relation to a pyrotechnic device called a fountain.
Figure 6:
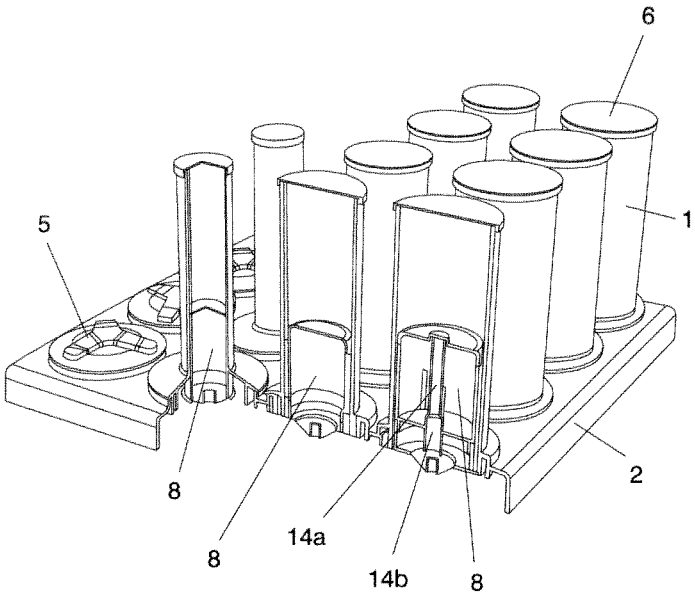
FIG. 6 shows a section view of pyrotechnic launching tubes having different calibres, coupled on a frame, inside of which different types of pyrotechnic devices are located.

In reference to FIG. 5, regarding the embodiment of the fountain type device, it can be seen how, differing from the shell type device of FIG. 4, sheath (14) comprises locking means (17*b*') with respect to interlocking means (17*a*) of the internal face of pyrotechnic launching tube (1), in such a way that sheath (14) is interlocked to its respective pyrotechnic launching tube (1); interlocking means (17*a*) and locking means (17*b*') being similar to the peripheral flange and to the peripheral step described previously, in this case to prevent said sheath (14), which is deployed higher than shot bowl (13), from being ejected outwards when firing.

Additionally, each pyrotechnic device (8) comprises an electric igniter (not shown), apt for providing the ignition of projection load (9) housed between pyrotechnic device (8) and locking element (3).

In light of FIG. 4 and the difference with FIG. 5, it can be seen that pyrotechnic device (8) comprises a cavity located inside sheath (14) of said pyrotechnic device (8) in which an explosive load is housed (14*a*). Likewise, with respect of said previous cavity in which explosive load (14*a*) is housed, pyrotechnic device (8) comprises another lower cavity (14*b*) located inside said sheath (14) and in which a delayed fuse is housed (not shown).

Additionally, in light of the figures it can be seen how one of the possible embodiments of the frame for pyrotechnic launching tubes disclosed by the invention comprises a base (4) preferably with walls, having a cubical or trapezoidal shape, and cover (2) in which pyrotechnic launching tubes (1) are coupled.

Base (4) of the frame has a peripheral gasket (15) that ensures airtightness with cover (2) and in which pyrotechnic launching tubes (1), inside of which pyrotechnic devices (8) are housed, are mounted over said cover (2)

Figure 2:
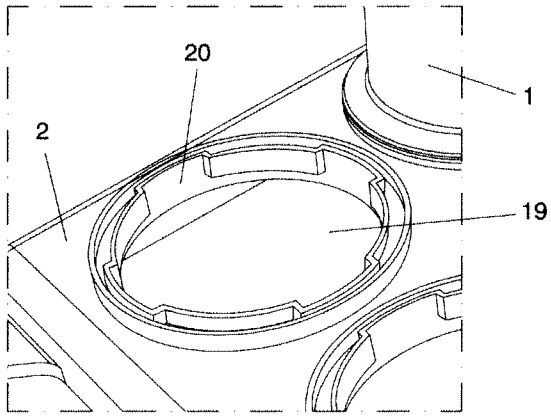
FIG. 2 shows a perspective view of the anchoring system of the pyrotechnic launching tubes to the frame cover

In light of FIG. 2, the coupling of each pyrotechnic launching tube (1) above cover (2) is done with an orifice (19) made on cover (2), in such a way that each orifice (19) is designed so that it can be engaged with a pyrotechnic launching tube (1) in a simple and safe manner. The geometry of the contour of orifice (19) is based on a circular shape, to which preferably four notches (20) have been made, and also of the semi-circular perimeter milled into sectors. The midpoints of notches (20) are deployed in a circumscribed shape of the circumference of orifice (19), at 90° with respect to each other. Both the sectors of notches (20) and the rest of orifice (19) extend their shape along the length of the cylindrical surface perpendicular to the flat surface of cover (2). Both remain at different heights, enabling each one of the sectors, having a rectangular frontal shape and laterally curved shape, to be fixed in high-relief over a cylinder of larger diameter in low-relief.

Orifices (19) made on cover (2) in a variable number, preferably 16, all of which constitute different firing outlets, are apt for fixing the different calibres of pyrotechnic launching tubes (1), as they all have a common bottom base.

A plug (5) is also installed, which is apt, if needed, for covering orifices (19) of cover (2), over which no pyrotechnic launching tube (1) is planned to be installed as part of the show.

As can be seen in FIG. 1, pyrotechnic launching tubes (1) will preferably have three different calibres, 30, 49 and 60 mm, all having a height of 170 mm, maintaining the common base for all of them, which enables adapting orifices (19) of cover (2) regardless of the calibre of pyrotechnic launching tubes (1).

All pyrotechnic launching tubes (1) are equipped on their bottom end with the same fixing system to cover (2). The system adopts a male-female engaging design that affects both the bottom portion of pyrotechnic launching tubes (1) and cover (2).

Pyrotechnic launching tube (1), in any of its different calibres, has a cylindrical shaped bottom end, with dimensions that are slightly smaller than orifices (19) made on cover (2). Around the contour of pyrotechnic launching tube (1) four bevelled and curved rectangular projections (21) forming a 90° angle with respect to the contiguous projection (21) and with respect to the imaginary rotation of the revolution of the pyrotechnic launching tube.

The male-female shape enables engaging pyrotechnic launching tube (1) above cover (2), by executing a simple rotating movement of 45°. Once done, each one of projections (21) of pyrotechnic launching tube (1) is trapped by each one of the four steps that comprise notches (29) inside each orifice (19) of cover (2).

With regard to plug (5), which is apt, if needed, for covering orifices (19) of cover (2) above which there is no intention of fixing a pyrotechnic launching tube (1), it is pointed out that it will likewise be equipped in its interior with four projections (22) that work in the same manner as the male-female shapes of pyrotechnic launching tubes (1), previously described.

Figure 3:
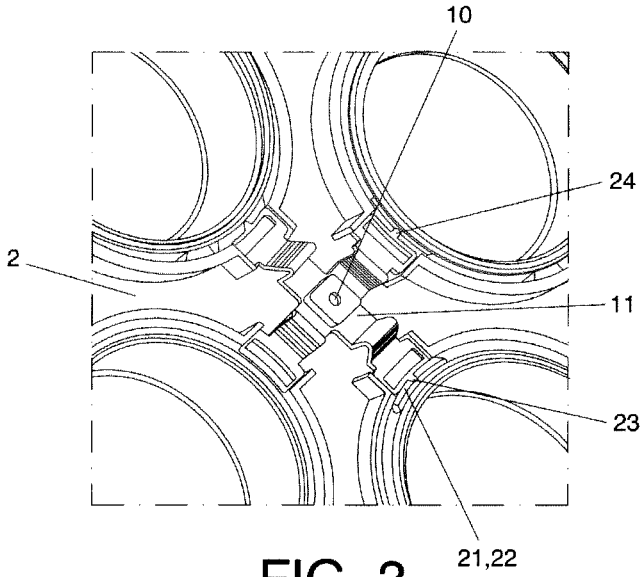
FIG. 3 shows a perspective view of the locking system element of the pyrotechnic launching tube in respect to the frame cover

The assembly, as can be seen in FIG. 3, is locked together by a retractable piece called the locking element (11), placed on the underside of cover (2) and fixed by means of a screw type joining element (10), on which said locking element (11) actuates to prevent accidental rotation, individually locking four pyrotechnic launching tubes (1) or plugs (5) Housed on the bottom face of each cover (2) there are one to four pieces of this type so as to be able to lock down up to 16 pyrotechnic launching tubes (1). Locking element (11), which is flexible, actuates automatically on pyrotechnic launching tube (1) by introducing a retaining element (23) that is solidary with the same locking element (11) from within the inside of cavity (24) milled at the midpoint of projections (21) of the engagement with pyrotechnic launching tube (1) once this has been engaged with a rotating action. The elasticity that the geometry provides the design enables actuating with the hand on the piece to retract one, several or all of retaining elements (23) that could lock pyrotechnic launching tubes (1).

For the purpose of ensuring airtightness of the assembly, a flat gasket (7) has been introduced made of elastic material which, located over the contour of each orifice (19) of cover (2), prevents rain or water from any other artistic source or any pyrotechnic debris from penetrating the interior of base (4). The geometry of flat gasket (7) is based on a circular shape on which a punch has made on its surface having the exact shape of the interior contour of orifices (19) of cover (2). This piece is inserted between cover (2) and each one of pyrotechnic launching tubes (1), or, lacking them, plugs (5), creating an airtight assembly.

Finally, pyrotechnic launching tubes (1) will have a top cover (6) located on their top end which prevents water, in case of rain, or undesirable pyrotechnic debris from entering.

In light of this description and the set of figures, a person skilled in the art will be able to understand that the embodiments of the invention which have been described can be combined in multiple ways within the scope of the invention. The invention has been described in accordance with some preferred embodiments of the same, although to a person skilled in the art it will be obvious that many variations can be introduced into said preferred embodiments without exceeding the scope of the invention claimed.

The invention claimed is:

1. A pyrotechnic launching device that comprises at least one pyrotechnic launching tube (1), at least one frame, which comprises a cover (2), in which the at least one said pyrotechnic launching tube (1) may be coupled and decoupled, and the device being characterised in that:

at least one said pyrotechnic launching tube (1) is prepared for housing inside it at least one pyrotechnic device (8)

at least one said pyrotechnic launching tube (1) comprises at least two openings located at its top and bottom ends that enable introducing and housing at least one said pyrotechnic device (8), both through its top opening and through its bottom opening;

at least one locking element (3), independent of the at least one pyrotechnic launching tube (1), and the at least one pyrotechnic device (8) that holds the at least one pyrotechnic device (8) and is located underneath the at least one pyrotechnic device; and in which the inside face of at least one said pyrotechnic launching tube (1) comprises interlocking means (17*a*) that enables locking at least one said pyrotechnic device (8), in a direct or indirect manner, through some locking means (17*b*, 17*b*') pertaining to at least one said pyrotechnic device (8).

2. The pyrotechnic launching device in accordance with claim 1, comprising an electric igniter housed between the at least one said pyrotechnic device (8) and between the at least one said locking element (3).

3. The pyrotechnic launching device in accordance with claim 1, wherein the at least one said locking element (3) comprises a plate geometry and comprises at least one notably cylindrical support (25).

4. The pyrotechnic launching device in accordance with claim 1, wherein the at least one said pyrotechnic device (8) comprises a geometry such that:

a bottom portion, called a shot bowl (13), comprises at least one housing that enables inserting inside it a projection load (9), and and a top portion called sheath (14) comprises at least one housing that enables inserting inside it a plurality of pyrotechnic components (16).

5. The pyrotechnic launching device in accordance with claim 4, characterised in that locking means (17*b*, 17*b*') are located on shot bowl (13) and/or on sheath (14) of at least one said pyrotechnic device (8).

6. The pyrotechnic launching device in accordance with claim 4, wherein the sheath (14) and shot bowl (13) comprise respective coupling means (26*a*, 26*b*) between them, which enable selective detachment of sheath (14) with respect of shot bowl (13).

7. The pyrotechnic launching device in accordance with claim 1, wherein locking means (17*b*, 17*b*') comprise a peripheral flange, or a succession of several projections, that externally surrounds at least one said pyrotechnic device (8), and interlocking means (17*a*) comprise a peripheral staggering or sequence of multiple grooves located on the inside face of at least one said pyrotechnic launcher tube (1) which interlocks with said peripheral flange, or sequence of ridges, in a male-female manner.

8. The pyrotechnic launching device in accordance with claim 1, wherein locking means (17*b*, 17*b*') comprise at least one projection deployed on the outside of at least one said pyrotechnic device (8), and interlocking means (17*a*) comprises at least one groove made vertically and deployed on the inside face of the body of at least one said pyrotechnic launching tube (1) that enables longitudinally shifting at least one said pyrotechnic device (8) along the internal face of the same, and its interlocking.

9. The pyrotechnic launching device in accordance with claim 1, wherein the interlocking means (17*a*) cooperates with a ring installed between at least one said pyrotechnic device (8) and at least one said pyrotechnic launching tube (1).

10. The pyrotechnic launching device in accordance with claim 4, wherein the at least one said pyrotechnic device (8) comprises a cavity located inside sheath (14) of at least one said pyrotechnic device (8) and in which at least one explosive load is housed (14*a*).

11. The pyrotechnic launching device in accordance with claim 1, wherein the coupling of at least one of said pyrotechnic tube launcher (1) over cover (2) is done with at least one orifice (19) made on cover (2), and in which said orifice (19) has a geometrically circular shape that comprises at least one semicircular peripheral notch (20) that is concentric to the circular geometry of said orifice (19); such that said pyrotechnic launching tube (1) has on its bottom portion a cylindrical shape having a notably smaller dimension than orifice (19) and in which around the bottom contour there is at least one bevelled projection (21) that engages with at least one said notch (20) in such a way that projection (21) is coupled to notch (20) and said pyrotechnic launching tube (1) is rotated with respect of its revolving axis, remaining engaged in said orifice (19).

12. The pyrotechnic launching device in accordance with claim 1, wherein the coupling of at least one of said one pyrotechnic launching tube (1) over cover (2) is done with at least one orifice (19) made on cover (2), and in which said pyrotechnic launching tube (1) comprises on its bottom portion at least one semicircular peripheral notch concentric to the circular geometry of orifice (19); such that said orifice (19) has on its bottom portion a cylindrical shape having a notably larger dimension than pyrotechnic launching tube (1) and in which around the bottom contour there is at least one projection that engages with at least one said notch, in such a way that the projection is coupled to the notch and said pyrotechnic launching tube (1) is rotated with respect of its revolving axis, remaining engaged in said orifice (19).

13. The pyrotechnic launching device in accordance with claim 11, wherein the at least one said pyrotechnic launching tube (1) comprises a geometric base in common so as to enable its adaptation of at least one said orifice (19) independently of the calibre of at least one said pyrotechnic launching tube (1).

14. The pyrotechnic launching device in accordance with claim 11, wherein at least one plug (5) covers said orifice (19) and further comprises on its bottom portion a cylindrical shape having a notably smaller dimension than orifice (19) and in which around the bottom contour there is at least one bevelled projection (22) that engages with at least one said notch (20) in such a way that projection (22) is coupled to notch (20) and said at least one plug (5) is rotated with respect of its revolving axis, remaining perfectly engaged in said orifice (19).

15. The pyrotechnic launching device in accordance with claim 14, wherein the at least one plug (5) can cover said orifice (19), and comprises on its bottom portion at least one notch having a semicircular perimeter and concentric to the circular geometry of orifice (19), such that the projection of orifice (19) couples with at least one said notch of the plug and said plug is rotated with respect of its revolving axis, remaining perfectly engaged in said orifice (19).

16. The pyrotechnic launching device in accordance with claim 11, wherein at least one locking element (11) of flexible material is located at the bottom portion of cover (2) in such a way that it comprises at least one retaining element (23) that is inserted inside a cavity (24) bevelled in the midpoint of said engagement projection (21, 22) of at least one said pyrotechnic launching tube (1) or of at least one said plug (5) once it is engaged with cover (2) by means of a manual rotation.

17. The pyrotechnic launching device in accordance with claim 16, characterised in that at least one said locking element (11) comprises a joining element (10) between said locking element (11) and cover (2).

18. The pyrotechnic launching device in accordance with claim 11, wherein at least one flat gasket is positioned over the contour of said orifice (19) and comprises a punch hole of the internal contour of said orifice (19), making the assembly airtight.

19. The pyrotechnic launching device in accordance with claim 1, wherein it comprises base (4) located underneath with respect of cover (2), and having between them a peripheral gasket (15) both that creates the airtightness of base (4) with cover (2).

* * * * *